US005774324A

United States Patent [19]

Hayashi et al.

[11] Patent Number: 5,774,324

[45] Date of Patent: Jun. 30, 1998

[54] SCOROTRON CHARGER FOR USE IN AN IMAGE FORMING APPARATUS

[75] Inventors: Shigeki Hayashi; Munetaka Mukainishi; Takeshi Aoki, all of Osaka, Japan

[73] Assignee: Mita Industrial Co., Ltd., Osaka-fu, Japan

[21] Appl. No.: 740,889

[22] Filed: Nov. 4, 1996

[30] Foreign Application Priority Data

Nov. 10, 1995 [JP] Japan ..... 7-293178

[51] Int. Cl.[6] ..... G03G 15/02

[52] U.S. Cl. ..... 361/225; 361/229; 399/171; 399/172

[58] Field of Search ..... 361/212, 213, 361/214, 225, 229, 230; 399/170–173; 250/324–326

[56] References Cited

U.S. PATENT DOCUMENTS 3,611,074 10/1971 Weichardt ..... 361/229

3,764,804 10/1973 Hirschman ..... 250/324

5,008,538 4/1991 DeCecca et al. ..... 250/324

5,241,344 8/1993 Takano ..... 250/324

*Primary Examiner*—Fritz Fleming

*Attorney, Agent, or Firm*—Jordan and Hamburg

[57] ABSTRACT

A scorotron charger has a charging wire extending in a specified direction supported in a housing member including a pair of side walls each extending in a direction parallel to the charging wire. An electrode member having a U-shape in cross section is mounted in the housing member and has a bottom plate in the form of a a grid electrode and a pair of upright side plates extending along the charging wire. A plurality of cutouts are formed in the side plates and are so arranged that positions of the cutouts in one side plate are displaced from that of cutouts in the other side plate. A plurality of projections are formed on the side walls of the housing member at positions corresponding to the respective cutouts for engaging with the cutouts.

5 Claims, 12 Drawing Sheets

SCOROTRON CHARGER FOR USE IN AN IMAGE FORMING APPARATUS

BACKGROUND OF THE INVENTION

This invention relates to a scorotron charger for use in an image forming apparatus to charge a surface of a photosensitive member.

Generally, image forming apparatuses such as facsimile and copying machines are operated as follows. A charger charges a surface of a photosensitive member having a form of a drum and an exposure portion exposes a specified area on the surface of the photosensitive member to form an electrostatic latent image. A developing portion supplies charged toner particles which are electrically attracted to the electrostatic latent image to develop the latent image into a toner image and a transferring portion transfers the toner image to a sheet of transfer paper transported to the surface of the photosensitive member. After the image transfer is complete, the transfer paper having the transferred toner image is separated from the photosensitive member surface and has the image fixed thereon in a fixing portion and is discharged outside the image forming apparatus.

In such an image forming apparatus, generally used as the charger is a corotron charger having a simplified construction. However, it is frequently the case that the image forming apparatus is equipped with a scorotron charger which is produced by providing a grid electrode to the corotron charger so as to uniformly charge a surface of a photosensitive member.

A scorotron charger of the prior art is described with reference to FIGS. 13 to 15. FIG. 13 is a partially cutout perspective view of a conventional scorotron charger 200, and FIG. 14 is a cross-sectional view of the scorotron charger 200 taken along the line XIVA—XIVA in FIG. 13.

The scorotron charger 200 is constructed in such a manner that a charging wire 202 is stretched in a housing portion 201 which is made of a synthetic resin and an electrode member 204, including a grid electrode 203 and a shield casing, is fixedly secured to the housing portion 201. The housing portion 201 is provided with the charging wire 202 and the electrode member 204 and is housed in an imaging unit along with a photosensitive member and a developing portion. Thus, the scorotron charger 200 achieves the purpose of reducing its size and saving time for assembling parts.

The scorotron charger 200 is operated as follows. When a bias voltage is applied to the grid electrode 203, and a high voltage is applied from a high voltage DC power supply to the charging wire 202, corona discharge is caused, thereby charging a surface of a photosensitive member at a specified potential level.

The electrode member 204 has a U-shape in cross section comprising a bottom plate formed with the grid electrode 203, and a pair of side plates 222 extending in the direction in which the charging wire 202 is stretched. The side plates 222 serve as a shield casing. The electrode member 204 is fixedly attached to the housing portion 201 in such a manner that the electrode member 204 surrounds the charging wire 202.

The scorotron charger 200 is disposed above the photosensitive member in such a state that the grid electrode 203 is spaced away from the photosensitive member surface by 1 to 2 mm. However, it is difficult to maintain the distance between the photosensitive member surface and the grid electrode 203 of the scorotron charger 200 at a specified constant value, and a variation of the distance is likely to occur along the longitudinal direction of the grid electrode 203 (i.e., the axial direction of the photosensitive member). As a result, a charged level on the photosensitive member surface is varied due to the distance variation. On the other hand, the distance between the housing portion 201 and the photosensitive member is kept constant, because the housing portion 201 and the photosensitive member are unitarily accommodated in the imaging unit. Accordingly, the electrode member 204 is required to be securely attached to the housing portion 201 at a high accuracy.

To meet the above requirement, the electrode member 204 of the conventional scorotron charger 200 is formed with a number of cutouts 205*a*, 205*b* (in this case, three on each side) at the side plates 222 respectively. As shown in FIG. 14, they are arranged in such a manner that the corresponding cutouts 205*a* and 205*b* in the opposite side plates 222 oppose each other. Further, the housing portion 201 is formed with projections 206*a*, 206*b* corresponding to the cutouts 205*a*, 205*b* respectively. The projections 206*a*, 206*b* each have a triangular shape in cross section so that the electrode member 204 is fixedly mounted to the housing portion 201 by fittingly inserting the projections 206*a*, 206*b* into the corresponding cutouts 205*a*, 205*b*. Thus, the grid electrode 203 is securely attached to the housing portion 201.

However, the conventional scorotron charger has the following drawbacks. Specifically, as shown in FIG. 15, when the surface of the photosensitive member 207 is charged by the charger 200, the surface potential of the photosensitive member 207 fluctuates, i.e., the surface potential is lowered in regions corresponding to the cutouts 205*a*, 205*b* which makes it difficult to charge the photosensitive member surface uniformly. It is most likely that the fluctuation of the surface potential results from the fact that corona discharge of the charging wire 202 is leaked out through the cutouts 205*a*, 205*b*.

SUMMARY OF THE INVENTION

It is therefore an object of the present invention to overcome the aforementioned drawback in the conventional technology. The present invention provides a scorotron charger, for use in an image forming apparatus to charge a photosensitive member, which includes a charging wire extending in a specified direction in a housing member including a pair of side walls, each extending in a direction parallel to the charging wire. An electrode member has a U-shape in cross section and is mounted to the housing member. The electrode member has a bottom plate with a grid electrode and a pair of upright side plates extending along the charging wire. A plurality of cutouts are formed in the side plates and are so arranged that a position of a randomly chosen one of the cutouts in one side plate along the charging wire is displaced from the positions of cutouts in the other side plate along the charging wire. A plurality of projections are formed on the side walls of the housing member at positions corresponding to the respective cutouts and engage the cutouts.

In the above arrangement, by engageably fitting the projections of the side walls of the housing member into the cutouts of the side plates of the electrode member, the electrode member is accurately positioned in the housing member. Further, the cutout of one side plate and the cutout of the other side plate of the electrode member are arranged asymmetrically with each other in relation to the charging wire, i.e., cutouts in the opposite plates are not symmetrically positioned from each other with respect to a vertical plane intersecting the charging wire. Therefore, leaking amounts of electric charges from the cutouts of the electrode member in given arreas are reduced when corona discharge occurs with a specified voltage applied to the charging wire. Accordingly, a surface of the photosensitive member is uniformly charged.

Preferably, the respective cutouts of the side plates of the electrode member are formed at positions away from intersecting lines of a plane, through the charging wire and in parallel with the bottom plate and the side plates.

In the above arrangement, the cutouts of the side plates of the electrode member do not lie on lines considered to be at the shortest distance from the charging wire. Thereby, leaking amounts of electric charges from the cutouts of the electrode member are further reduced which in turn results in that the surface of the photosensitive member is uniformly charged when the scorotron charger is used in the image forming apparatus.

Another embodiment of a scorotron charger according to the present invention has a charging wire extending in a specified direction within a housing member including a pair of side walls, each extending in a direction parallel to a logitudinal direction of the charging wire, and an electrode member having a U-shape in cross section. The electrode member is mounted to the housing member and has a bottom plate provided with a grid electrode and a pair of side plates extending upward from the grid electrode. Cutouts are formed in the side plates of the electrode member at positions away from intersecting lines of a plane, passing through the charging wire and in parallel with the bottom plate, and the side plates. The side walls of the housing member are provided with projections at positions corresponding to the respective cutouts for engaging with the cutouts.

Preferably, the cutouts of one of the side plates of the electrode member are arranged on the same side in the respective plate with respect to the intersecting line.

Furthermore, it may be further preferable to place all the cutouts on the side distant from the grid electrode ( bottom plate ). In such an arrangement, since there is a greater distance to the cutouts, where the leakage takes place, from not only the charging wire but the grid electrode, leaking amounts of electric charges from the cutouts of the electrode member are further reduced when corona discharge occurs with a specified voltage applied to the charging wire. Accordingly, a surface of the photosensitive member is uniformly charged.

Still in another embodiment of the present invention, it is possible that the cutouts of one of the side plates of the electrode member are arranged below the intersecting line (see L1 in FIG. 7C), while the cutouts of the other side plate are arranged above the intersecting line (see L2 in FIG. 7C).

The above and other objects, features and advantages of the present invention will become more apparent upon a reading of the following detailed description and drawings.

DETAILED DESCRIPTION OF THE INVENTION

Figure 2:
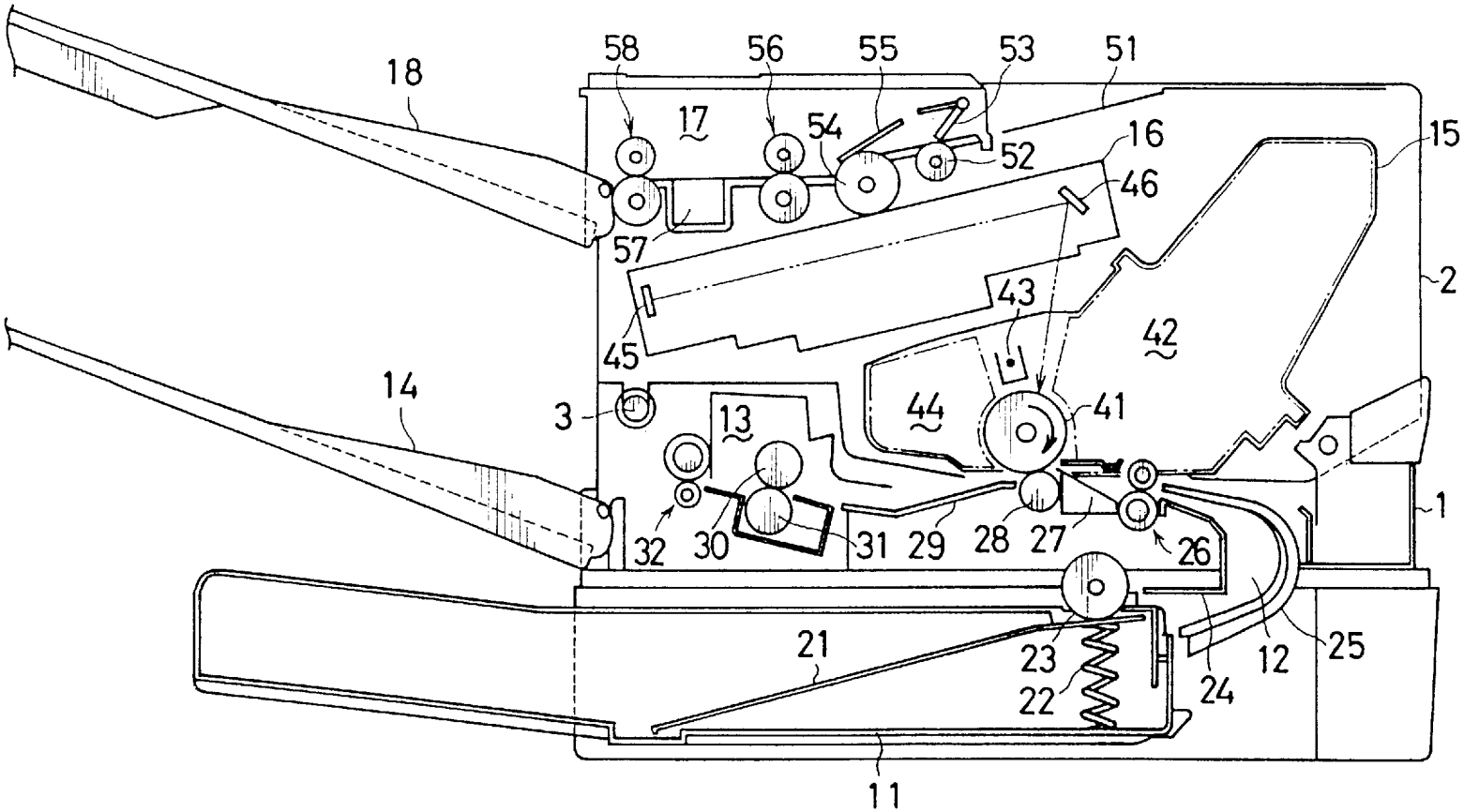
FIG. 2 is a front view showing an internal arrangement of the facsimile machine.

Referring to FIG. 2 a front view of an internal arrangement of a facsimile machine having a scorotron charger of the present invention is shown. The facsimile machine comprises a lower main body 1 and an upper main body 2. The upper main body 2 is mounted rotatable about a pivot shaft 3 arranged in an appropriate position on a left end of the facsimile machine with respect to the lower main body 1. Thus, the facsimile machine is openable at a right side in FIG. 2.

The lower main body 1 includes a cassette 11 arranged in a lower portion, a transfer paper transport path 12 disposed above the cassette 11, a fixing portion 13, and a transfer paper discharge tray 14 extensively arranged at the left end of the facsimile machine.

The cassette 11 is adapted for storing a number of cut sheets of transfer paper from a stacked state. The cassette 11 is arranged with a sheet holding plate 21 at a right half portion thereof. A spring 22 is vertically arranged between a right end of the sheet holding plate 21 and a specified position on a bottom portion of the cassette 11. A feed roller 23 is disposed above the right end of the sheet holding plate 21. An uppermost sheet of transfer paper stacked on the sheet holding plate 21 is brought into contact with a circumference of the feed roller 23 due to a biasing force of the spring 22. When the feed roller 23 is rotated, the cut sheets of transfer paper are dispensed one by one from the uppermost position in the cassette 11.

The transfer paper transport path 12 comprises a U-shaped inner guide plate 24 and a U-shaped outer guide plate 25. The uppermost transfer paper dispensed from the cassette 11 is guided downstream, corresponding to a direction of transporting transfer paper along the transfer paper transport path 12, to a registration roller pair 26 disposed downstream of the transfer paper transport path. The transfer paper is transported by the registration roller pair 26 to a guide plate 27, transfer roller 28, and to a guide plate 29 disposed downstream of the registration roller pair 26 in this order. The transfer roller 28 is disposed so as to be brought into contact with a photosensitive member 41 at respective circumferential surfaces thereof when the upper main body 2 is mounted to the lower main body 1 to close the facsimile machine. The photosensitive member 41 is described below.

The guide plate 29 is adapted for guiding transfer paper after image transfer to the fixing portion 13. The fixing portion 13 comprises a heater roller 30 and a presser roller 31. A sheet discharge roller pair 32 is disposed downstream of the fixing portion 13.

The upper main body 2 includes an imaging unit 15, an optical system 16, a document image reader 17, and a document discharge tray 18 arranged extensively at the left end of the facsimile machine. The imaging unit 15 is detachably inserted into an accommodating portion formed in a lower part of the upper main body 2.

The imaging unit 15 includes the photosensitive member 41 in the form of a drum, and various peripheral devices such as a developer 42, a scorotron charger 43, and a cleaner 44 which are arranged downstream with respect to the photosensitive member 41 in this order. A construction of the imaging unit 15 is described below.

The optical system 16 is adapted for exposing a specified area on the surface of the photosensitive member by projecting a light image. The optical system 16 comprises a light emitter 45 including a light source emitting a laser beam using a polygonal mirror, and a reflective mirror 46 which reflects a beam of laser light emitted by the light emitter 45 toward the photosensitive member 41.

The document image reader 17 includes a document placement portion 51, forwarding roller 52, document transport restricting member 53, separation roller 54, separation plate 55, transport roller pair 56, document image reading sensor 57, and document discharge roller pair 58 in this order in a direction of transporting a document.

Figure 3:
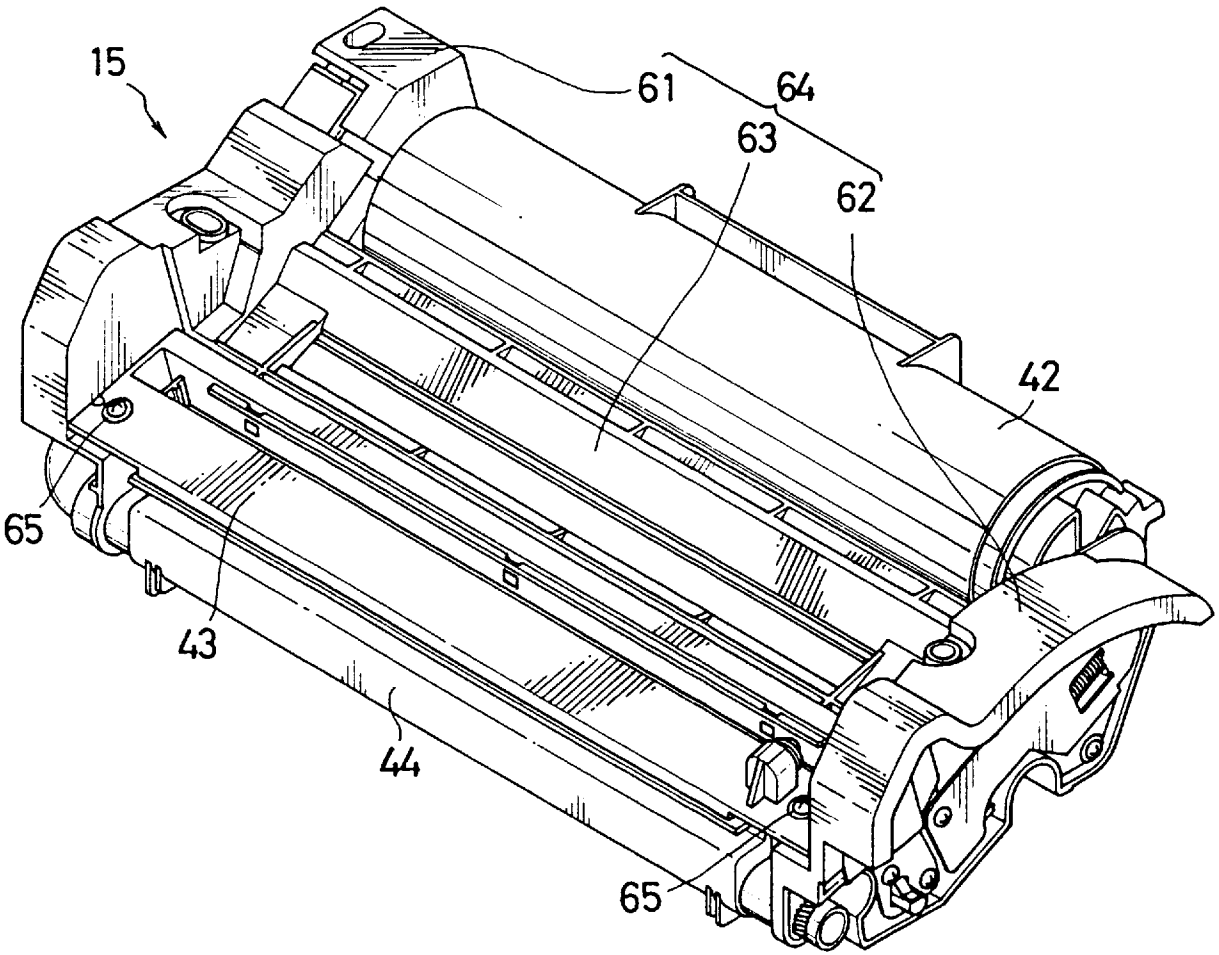
FIG. 3 is a perspective view of an imaging unit of the facsimile machine when viewed from above.
Figure 4:
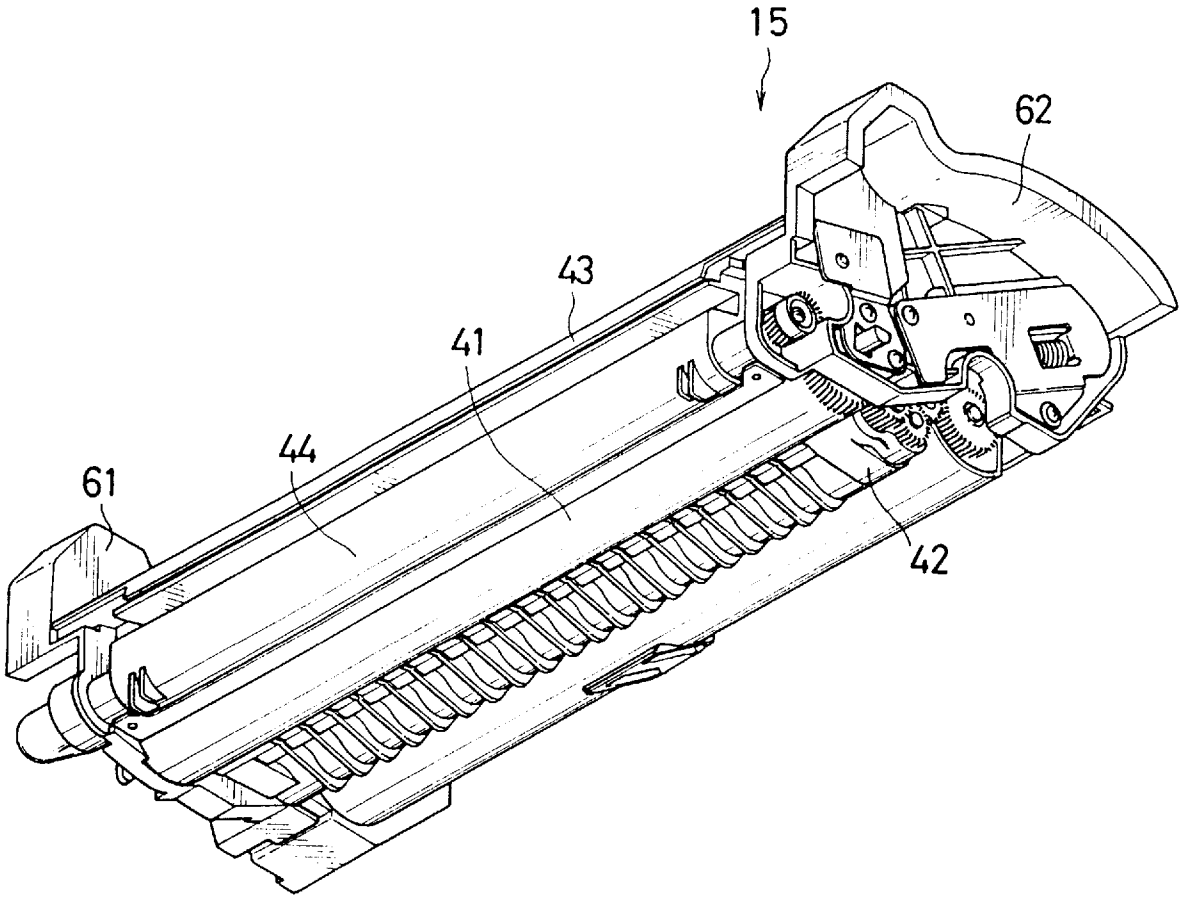
FIG. 4 is a perspective view of the imaging unit when viewed from below.

Referring to FIGS. 3 and 4 are perspective views of the imaging unit 15 when viewed from above and below, respectively, are shown. The imaging unit 15 includes a frame body 64 made of a synthetic resin. The frame body 64 comprises side frame members 61, 62 which are arranged at opposite sides in an axial direction of the photosensitive member 41, and an intermediate member 63. The side frame members 61, 62 and intermediate member 63 are integrally molded to form the frame body 64. Various parts such as the photosensitive member 41 and developer are arranged inside the frame body 64.

As shown in FIG. 4, the photosensitive member 41 has a drum shape and an axial length substantially greater than a width of transfer paper. The photosensitive member 41 is rotatably supported between the side frame members 61 and 62. As also shown in FIG. 4, the developer 42 is arranged near the photosensitive member 41 in a state that the developer 42 is also supported by the side frame members 61 and 62. The scorotron charger 43 is fixedly mounted to the side frame members 61 and 62 by means of screws 65, 65 (FIG. 3). The cleaner 44 is, as shown in FIG. 4, arranged near the photosensitive member 41 in a state that the cleaner is also supported by the side frame members 61 and 62.

Thus, since the peripheral devices such as the developer 42, scorotron charger 43, and cleaner 44 are unitarily arranged in the frame body 64 together with the photosensitive member 41, these peripheral devices are positioned accurately with respect to the photosensitive member 41.

Figure 5:
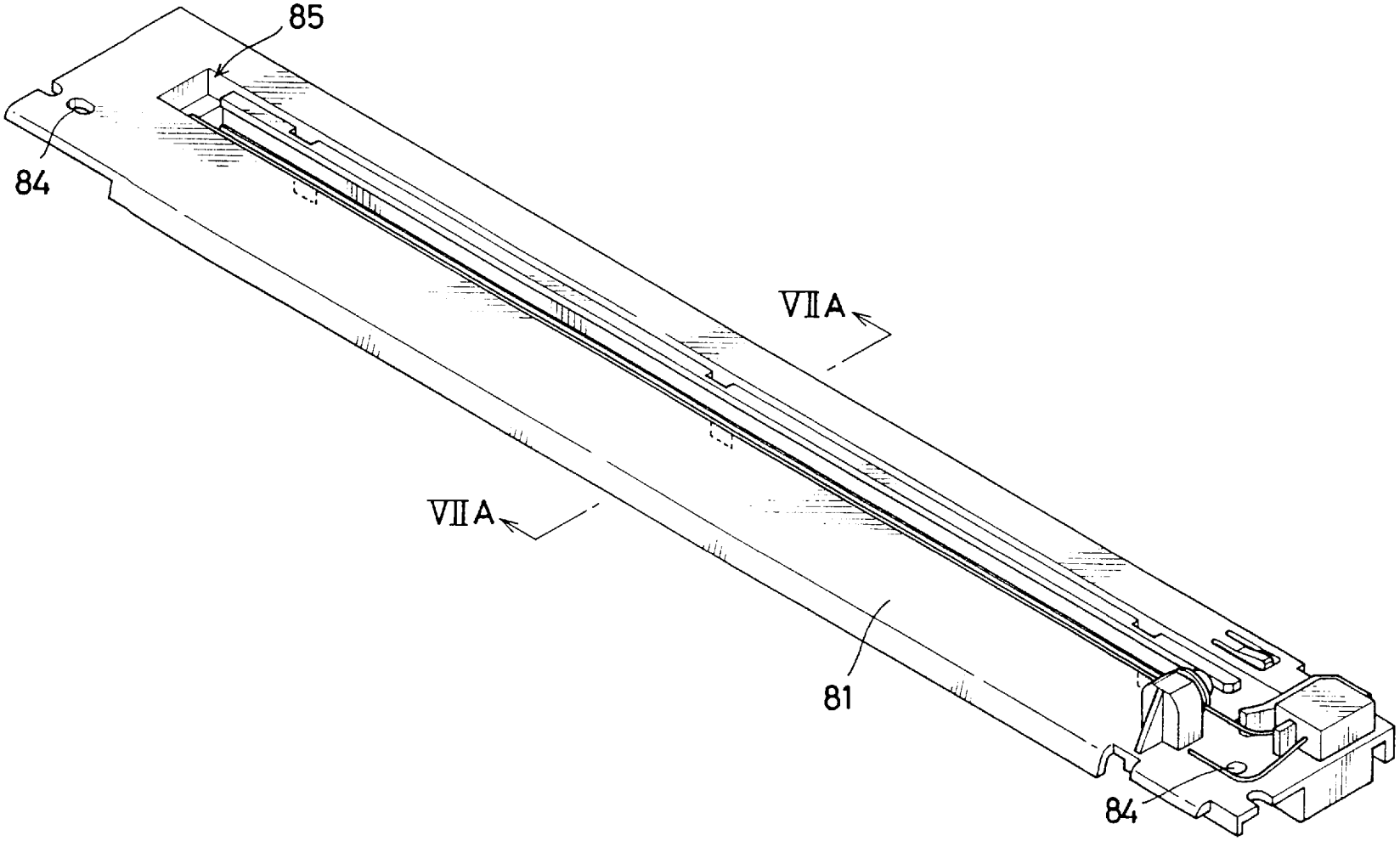
FIG. 5 is a perspective view of the scorotron charger when viewed from above.
Figure 6:
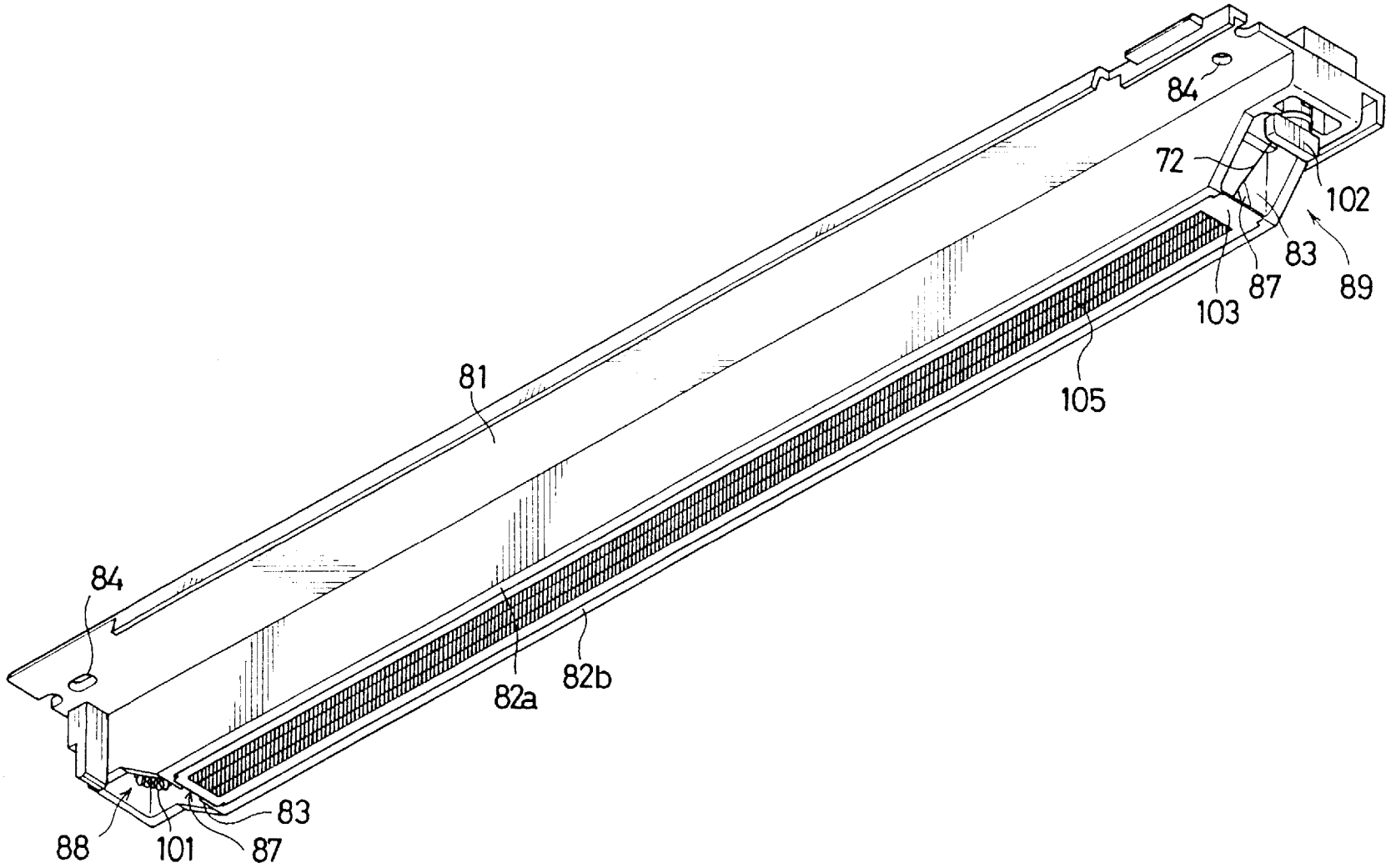
FIG. 6 is a perspective view of the scorotron charger when viewed from below.
Figure 7A:
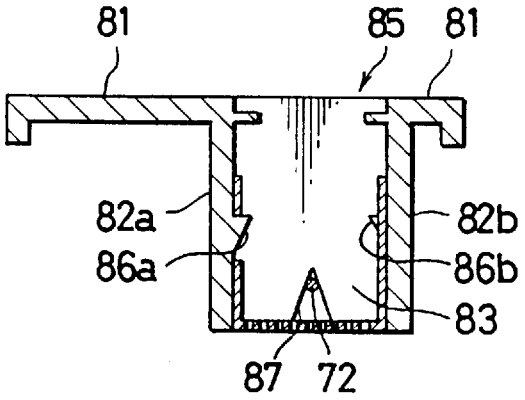
FIG. 7A is a cross-sectional view of the scorotron charger taken along the line VIIA—VIIA in FIG. 5.
Figure 7B:
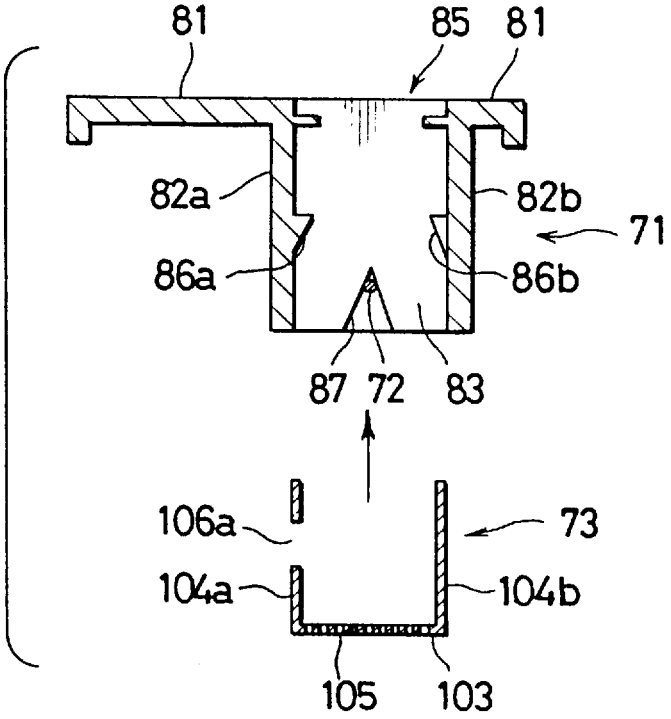
FIG. 7B is a cross-sectional view of the scorotron charger in a state that an electrode member is to be mounted in a housing portion of the charger.

Referring to FIGS. 5, 6, 7A, 7B and 7C, the scorotron charger 43 is described in detail. As shown in FIG. 7B, the scorotron charger 43 comprises a housing portion 71 made of a synthetic resin, a charging wire 72 of a small diameter and made of a metal such as tungsten, and an electrode member 73 made of a metal such as aluminum or stainless steel. The scorotron charger 43 is constructed by arranging the charging wire 72 and electrode member 73 in the housing portion 71 in a manner described below.

The housing portion 71 has, as shown in FIGS. 5 and 6, a planar plate 81 having an elongated shape when viewed from above, side walls 82*a*, 82*b*, and end walls 83, 83. The side walls 82*a*, 82*a* vertically and opposingly project downward from a lower surface of the planar plate 81 by a specified dimension over an entire length of the planar plate 81. The end walls 83, 83 project vertically and opposingly downward from the lower surface of the planar plate 81 spaced apart by a distance substantially equal to the axial length of the photosensitive member 41. The side wall 82*a* (82*b*) meets the end wall 83 (83) at a right angle.

The planar plate 81 is formed with holes 84, 84 respectively at a specified position on the opposite sides thereof in the longitudinal direction. The housing portion 71 is mountable to the frame body 64 by use of screws through the holes 84, 84 of the planar plate 81. The planar plate 81 is, as shown in FIG. 5, formed with an opening 85 in the form of an elongated rectangle whose extending direction is in parallel with the longitudinal direction of the planar plate 81. Thus, the housing portion 71 has a casing formed into the form of a rectangular parallelopiped defined by the side walls 82*a*, 82*b* and 83, 83 without top and bottom covers.

As shown in FIGS. 7A and 7B, the side wall 82*a* is internally formed with a number of projections 86*a* having a triangular shape in cross section, while the side wall 82*b* is also internally formed with a number of projections 86*b* having a triangular shape in cross section. The end walls 83, 83 are formed with cutout projections 87, 87 each in the downwardly opening V-shape.

The planar plate 81 is, as shown in FIG. 6, further provided with block members 88, 89 at the opposite ends of the side wall 82*a* 82*b* in the longitudinal direction, outside the end walls 83, 83.

The charging wire 72 has, as shown in FIG. 6, one end thereof mounted to the block member 88 by a helical spring 101, and has the other end thereof mounted to the block member 89 by an attachment 102. The charging wire 72 is stretched inside the housing portion 71 by the coil spring 101 while being supported by bottoms of the cutout portions 87, 87 (V notch portion) of the side walls 83, 83.

The charging wire 72 is connected to a high voltage DC power supply (not shown) providing several kilo volts through an unillustrated distribution cable. The charging wire 72 causes corona discharge when the high voltage is applied.

The electrode member 73 has a U-shape in cross section, as shown in FIGS. 7A and 7B. Namely, the electrode member 73 comprises a bottom plate 103, and side plates 104*a*, 104*b* formed by folding a thin metal plate. The electrode member 73 is connected to a power source (not shown) by means of an unillustrated distribution cable. When the power source is turned on, a bias voltage is applied to the electrode member 73.

The bottom plate 103 is, as shown in FIG. 6, formed with a grid electrode 105. The side plates 104*a*, 104*b* serve as a shield casing. As shown in FIG. 7B, the side plate 104*a* is formed with a number of cutouts 106*a* each having a size slightly larger than that of the projection 86*a* of the side wall 82*a* of the housing portion 71. Likewise, the side plate 104*b* is formed with a number of cutouts 106*b* each having a size slightly larger than that of the projection 86*b* of the side wall 82*b*

Figure 1:
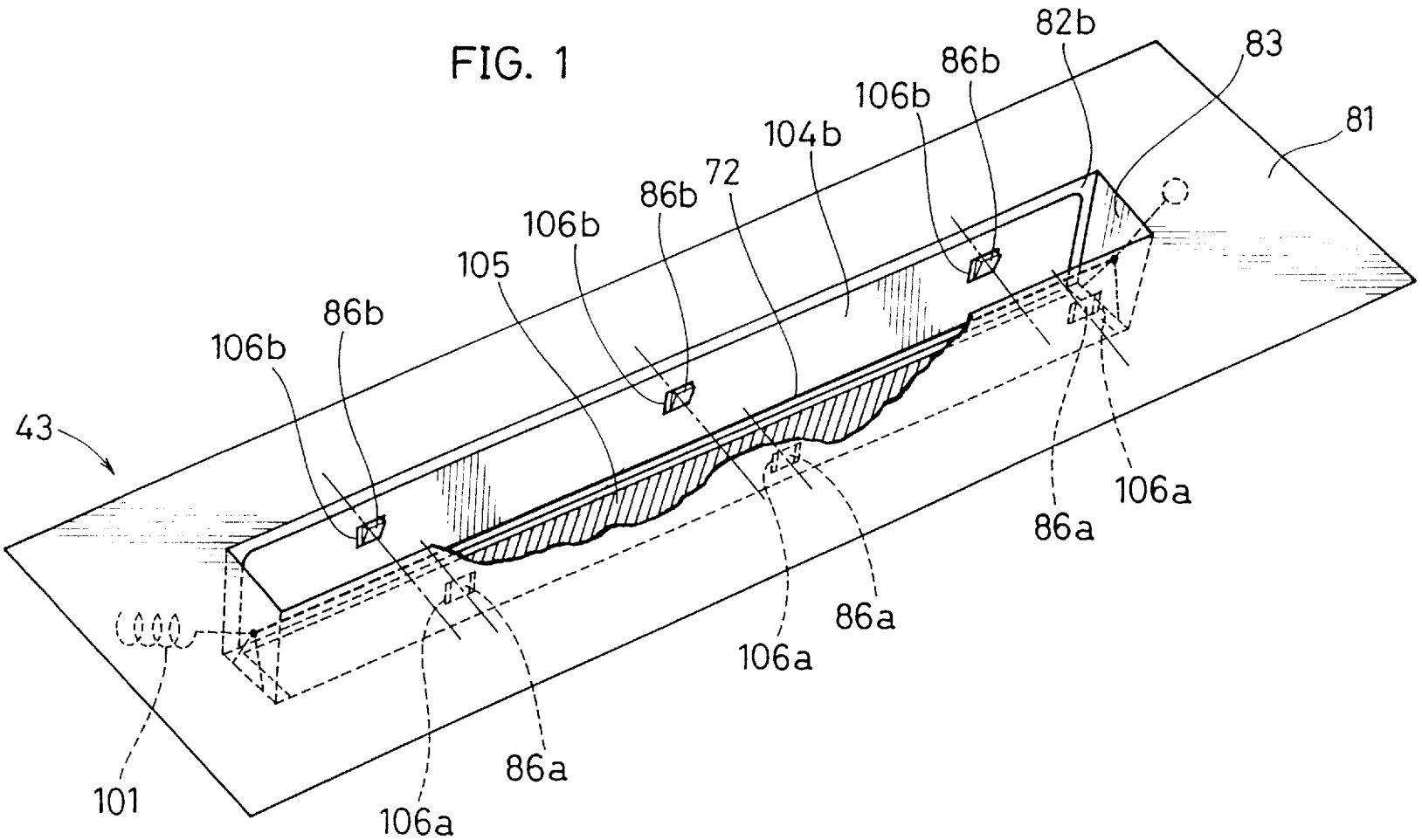
FIG. 1 is a perspective view schematically showing a scorotron charger for use in a facsimile machine embodying the present invention.
Figure 7C:
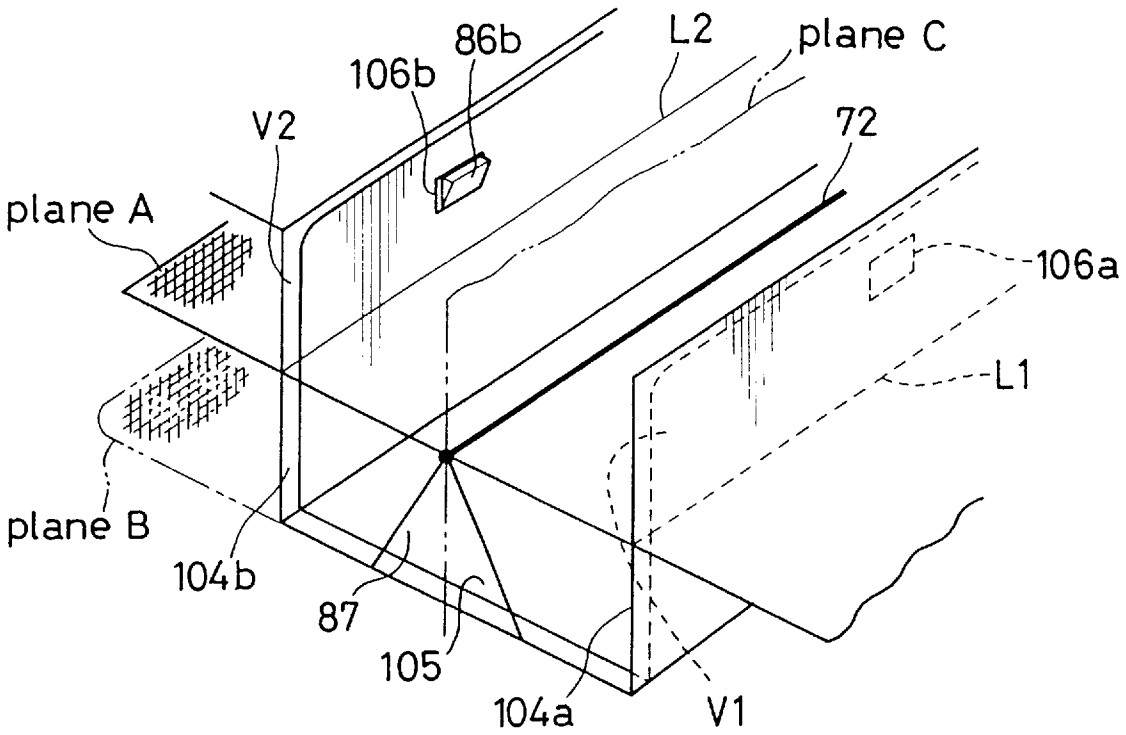
FIG. 7C is a schematic diagram showing an arrangement of cutouts of electrode of the scorotron in FIG. 1 in relation to the charging wire.

Referring to FIG. 1, a perspective view schematically showing the scorotron charger 43 illustrates the positional relationship of the projection 86*a* (86*b*) and cutout portion 106*a* (106*b*). Furthermore, FIG. 7C is a schematic diagram showing an arrangement of cutouts of the electrode element shown in FIG. 1 in relation to the charging wire 72. In FIG. 7C let us set an imaginary plane A (or simply a plane A) through the charging wire 72 and in parallel with the bottom plate 103 (corresponding to a bottom plane B). Furthermore, a plane C is set passing through the charging wire 72 and perpendicular to the plane A and the plane B. The lines L1, L2 and charging wire 72 lie in the same plane A. Two intersecting lines L1, L2 are defined at the intersections of the plane A and the vertical planes V1, V2, coinciding with the inner surfaces of the side plates 104A, 104B.

With the embodiment shown in FIG. 1, the cutouts 106*a* are vertically displaced from the intersecting line L1 of the plane A and the vertical plane V1, while the cutouts 106*b* are vertically displaced from the intersecting line L2. In other words, the cutouts 106*a* and 106*b* are vertically displaced with respect to the plane A.

Further, the cutout 106*a* of the side plate 104*a* and the cutout 106*b* of the side plate 104*b* are so positioned that they do not oppose to each other. In other words, cutouts 106*a* and 106*b* are asymmetrically arranged with respect to the plane C.

The housing portion 71 is formed with the projection 86*a* of the side wall 82*a* and the projection 86*b* of the side wall 82*b* at a position corresponding to the cutout portion 106*a* of the side plate member 104*a* and the cutout portion 106*b* of the side plate member 104*b* respectively.

In this way, as shown in FIG. 7B, the scorotron charger 43 is constructed by engageably inserting the electrode member 73 in sliding contact with the side walls 82*a*, 82*b* and 83, 83 from below with respect to the housing portion 71 within which the charging wire 72 is stretched. At this time, as shown in FIG. 6, opposite ends of the bottom plate 103 of the electrode member 73 in the longitudinal direction come into contact with lower ends of the side walls 83, 83 of the housing portion 71, while the projections 86*a* are engageably inserted into the corresponding cutouts 106*a*, and the projections 86*b* are engageably inserted into the corresponding cutouts 106*b* as shown in FIGS. 1 and 7A. Thereby, the electrode member 73 is accurately positioned with respect to the housing portion 71.

An operation of the facsimile machine having the scorotron charger 43 is described next.

In facsimile data receiving mode, image signals received through an unillustrated telephone line are temporarily stored in an unillustrated memory.

In facsimile data transmission mode and copying mode, a document image is first read. Specifically, a lowermost document of documents stacked on the document placement portion 51 is fed by the forwarding roller 52 while the other documents have their transport temporarily suspended by the document transport restricting member 53. Then, the lowermost document is separated from the other documents by a separator comprising the separation roller 54 and the separation plate 55 and transported to the transport roller pair 56, where the lowermost document is transported at a specified transport speed and has its original document image read by the image reading sensor 57 line by line. The document image read by the sensor 57 is output to the memory as an image signal. The document whose image has been read out by the sensor 57 is discharged by the document discharge roller pair 58 onto the document discharge tray 18. Likewise, the remaining documents stacked on the document placement portion 51 are transported one after another to the document image reader 17 where their original images are read and are discharged onto the document discharge tray 18 one after another.

Subsequently, when data is to be transmitted in the facsimile data transmission mode, the image signals temporarily stored in the memory are transmitted to a facsimile machine for data transmission which is designated by an unillustrated designator via a telephone line.

On the other hand, when the copying mode or facsimile data receiving mode is designated, the image signals temporarily stored in the memory are output for image recording on transfer paper.

Specifically, the scorotron charger 43 charges a surface of the photosensitive member 41 at a specified potential, the light emitter 45 emits a laser beam in accordance with the image signals stored in the memory, and a specified area of the photosensitive member is exposed to a light image reflected by the reflective mirror 46 to form an electronic latent image on the photosensitive member 41. Subsequently, charged toner particles supplied from the developer 42 to the photosensitive member 41 are electrically attracted to the latent image on the photosensitive member to develop the latent image into a toner image.

Transfer paper sheets, stored in the cassette 11, are dispensed by the feed roller 23 one by one and transported to the registration roller pair 26 in timed relation with the developing operation. The thus transported transfer paper is then transported between the photosensitive member 41 and the transfer roller 28 while being guided along the guide plate 27. After having the toner image being transferred by the transfer roller 28, the transfer paper carrying the toner image is separated from the photosensitive member 41 and transported downstream along the guide plate 29. Then, after having the toner image fixed by the heater roller 30 and the presser roller 31 of the fixing portion 13, the transfer paper carrying the fixed toner image is discharged onto the transfer paper discharge tray 14 by the transfer paper discharge roller pair 32.

As mentioned above, the electrode member 73 is formed with the cutout 106*a* of the side plate 104*a* and the cutout 106*b* of the side plate 104*b* positioned such that the cutouts 106*a* and 106*b* are asymmetrically displaced with respect to the vertical plane C. Accordingly, reduced is an amount of electric charges leaking through engaging portions between the cutouts and projections during corona discharge, compared to the conventional scorotron charger in which the cutouts on the opposing side members are opposed to each other.

Further, the cutouts 106*a* and 106*b* are vertically displaced from each other with respect to the horizontal plane A. Accordingly, avoided is the situation of the conventional scorotron charger in which the distance between the cutout portion 205*a* (205*b*) and the charging wire 202 is the smallest. Hence, further reduced is the amount of electric charges leaking through the engaging portions during corona discharge by the charging wire 72.

Figure 8:
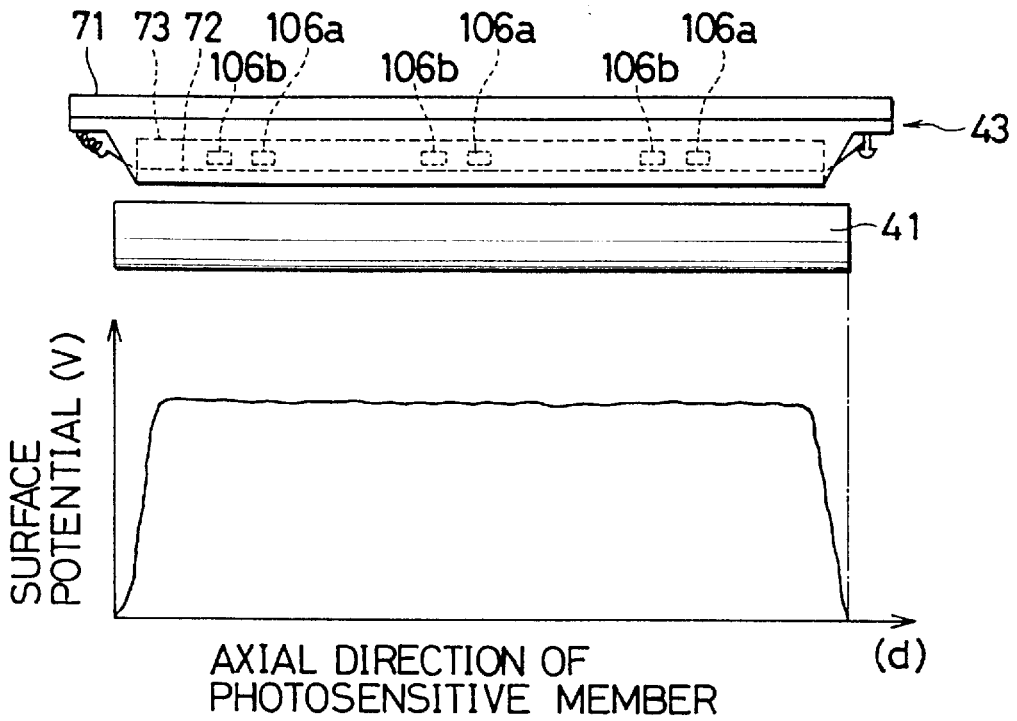
FIG. 8 is a diagram showing a relationship between the construction of the scorotron charger and a surface potential of a photosensitive member when being charged by the scorotron charger.

When the scorotron charger 43 having the above arrangement charges the surface of the photosensitive member 41, as shown in FIG. 8, a surface potential of the photosensitive member 41 at a position corresponding to the engaging portion between the cutout portion 106*a* (106*b*) and projection 86*a* (86*b*) is not lowered, and accordingly, the surface of the photosensitive member can be charged uniformly. Thereby, a clear image can be recorded on transfer paper.

In the foregoing embodiment, the side plate 104*a* (104*b*) of the electrode member 73 is formed with three cutouts 106*a* (10*b*). However, the number of cutouts is not limited to the above. For example, one side plate member may be formed with two cutouts near opposite ends in the longitudinal direction, while the other side plate member may be formed with one cutout portion in an intermediate portion.

The present invention also includes various embodiments shown in FIGS. 9 to 12 concerning modification of the position of the cutout portion (and the projection). It should be appreciated that in each modification, elements identical to those in the foregoing embodiment are indicated by the same reference numerals.

Figure 9:
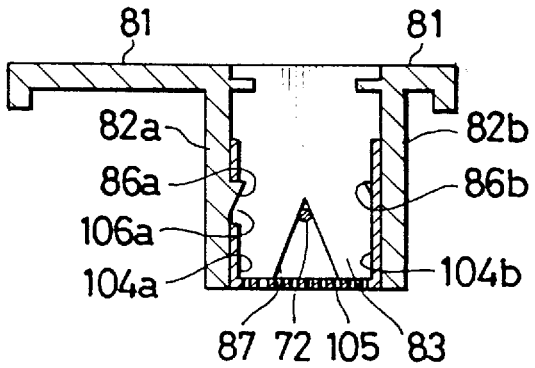
FIG. 9 is a cross-sectional view of the scorotron charger of a first modification.

FIG. 9 shows a first modification. Similarly to the above embodiment, cutouts 106*a* and 106*b* of the first modification are asymmetrically arranged from each other with respect to the extending direction of the charging wire 72 or the plane C (in FIG. 7C). However, the first modification differs from the above embodiment in that the cutouts 106*a* and 106*b* of the first modification are formed on the horizontal plane A (see FIG. 7C) containing a charging wire 72. With this arrangement, also reduced is the amount of electric charges leaking through cutouts during corona discharge, and the surface of the photosensitive member 41 can be charged more uniformly, compared to the conventional scorotron charger in which the cutouts on the opposing side members are symmetrically arranged with respect to the charging wire (the plane C in FIG. 7C).

Figure 10:
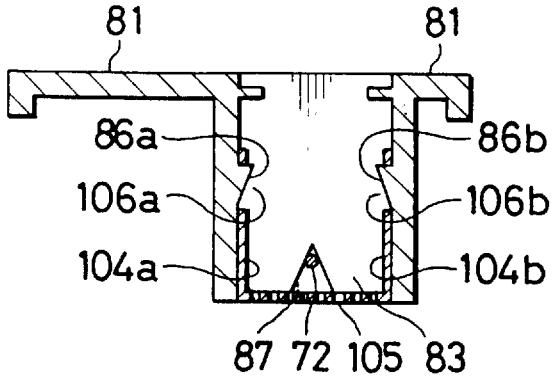
FIG. 10 is a cross-sectional view of the scorotron charger of a second modification.
Figure 11:
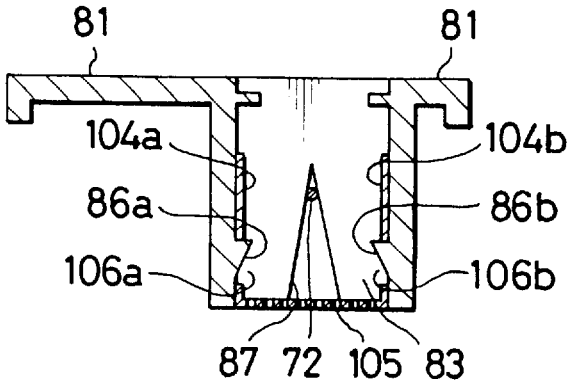
FIG. 11 is a cross-sectional view of the scorotron charger of a third modification.

FIGS. 10 and 11 respectively show second and third modifications. Similarly to the aforementioned embodiment, cutouts 106*a* and 106*b* of the second and third modifications are vertically displaced with respect to the horizontal plane A (FIG. 7C), although they are arranged symmetrically with respect to the vertical plane C (FIG. 7C). With this arrangement, avoided is the situation that the distance between the cutout portion 106*a* (106*b*) and a charging wire 72 is the smallest, because the cutouts are vertically displaced with respect to the horizontal plane A. Accordingly, also reduced is the amount of electric charges leaking through cutouts during corona discharge, and the surface of the photosensitive member 41 can be charged more uniformly, compared to the conventional scorotron charger in which the cutouts on the opposing side members are arranged on the horizontal plane A (see FIG. 7C) containing the charging wire.

More specifically, the cutouts 106*a* and 106*b* of the second modification are arranged above the horizontal plane A away from a grid electrode 105 formed in a bottom plate 103, while those of the third modification are arranged below the horizontal plane A near the grid electrode 105. Accordingly, the second modification can more effectively attain uniform charging of the surface of the photosensitive member 41 than the third modification because of availability of more distance to the cutouts from the grid electrode.

Figure 12:
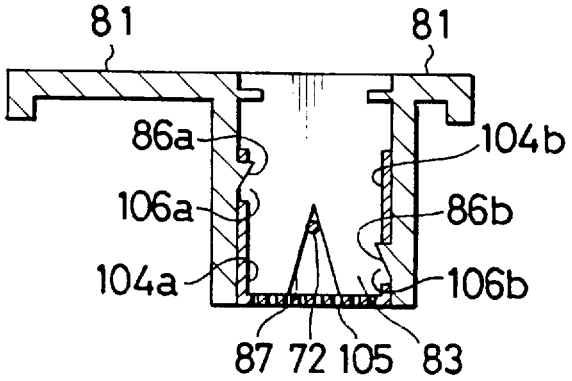
FIG. 12 is a cross-sectional view of the scorotron charger of a fourth modification.
Figure 13:
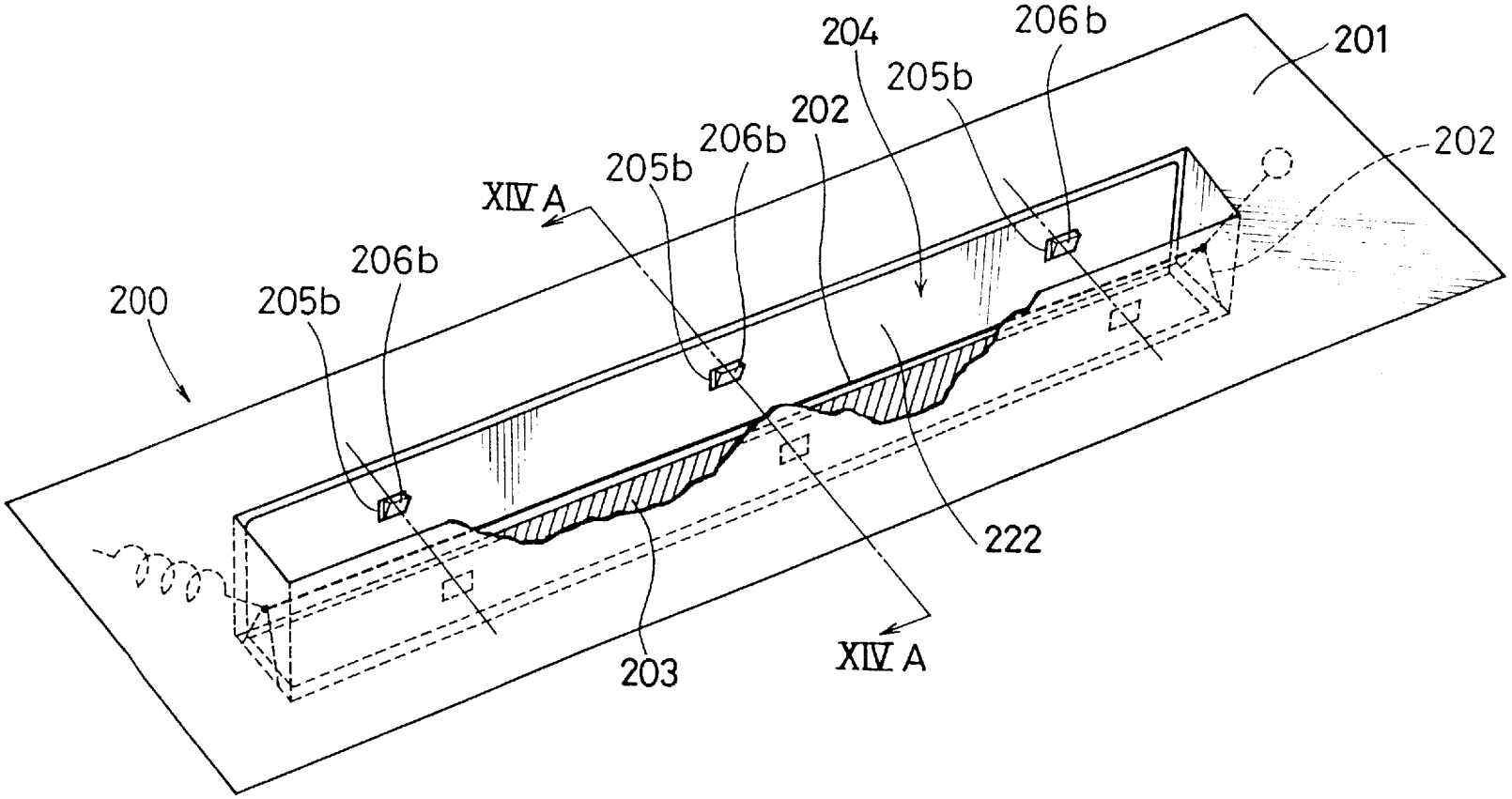
FIG. 13 PRIOR ART
FIG. 13 is a perspective view of a scorotron charger of the prior art.
Figure 14:
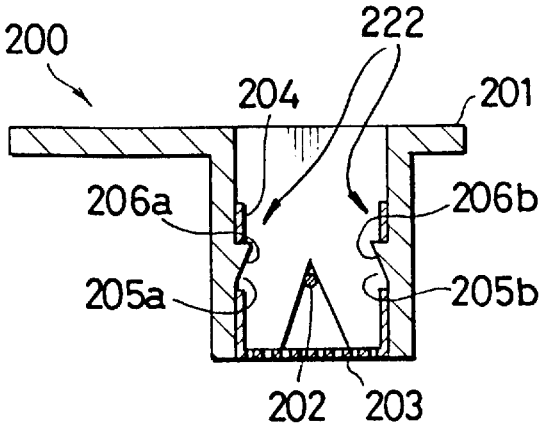
FIG. 14 PRIOR ART
FIG. 14 is a cross-sectional view of the conventional scorotron charger taken along the line XIVA—XIVA in FIG. 13.
Figure 15:
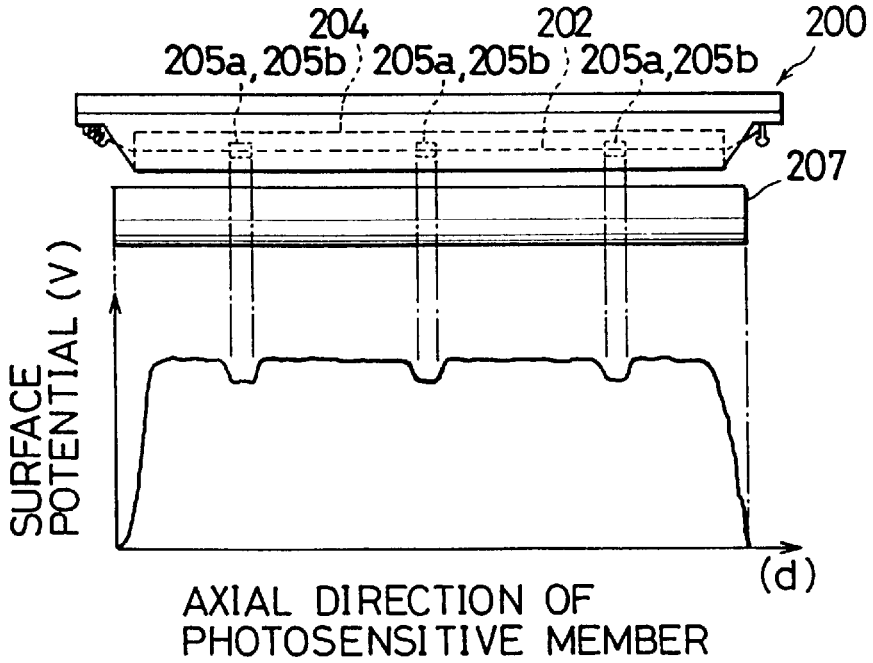
FIG. 15 PRIOR ART
FIG. 15 is a diagram showing a relationship between the construction of the conventional scorotron charger and a surface potential of a photosensitive member when being charged by the conventional scorotron charger.

FIG. 12 shows a fourth modification. The fourth modification differs from the second (or third) modification in that cutouts 106*a* are arranged above the horizontal plane A away from a grid electrode 105, while cutouts 106*b* are arranged below the horizontal plane A near the grid electrode 105, and vice versa. Also, with this arrangement, avoided is the situation that the distance between the cutout portion 106*a* (106*b*) and a charging wire 72 is the smallest, because the cutouts are vertically displaced with respect to the horizontal plane A (see FIG. 7C). Accordingly, also reduced is the amount of electric charges leaking through cutouts during corona discharge, and the surface of the photosensitive member 41 can be charged more uniformly, compared to the conventional scorotron charger in which the cutouts on the opposing side members are arranged on the horizontal plane A including the charging wire.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. A scorotron charger for charging a photosensitive member in an image forming apparatus, the scorotron charger comprising:

a charging wire extending in a specified direction;

a housing member including a pair of side walls each extending in a direction parallel to the charging wire;

an electrode member having a substantially U-shaped cross section, mounted to the housing member, including a bottom plate with a grid electrode and a pair of upright side plates extending along the charging wire a plurality of cutouts formed in the side plates;

said cutouts being disposed at positions in said side plates such that entire peripheries of said cutouts are further from said bottom plate than said charging wire is from said bottom plate; and a plurality of projections formed on the side walls of the housing member at positions corresponding to respective ones of the cutouts for engaging with the cutouts and securing said electrode member in said housing member.

2. A scorotron charger according to claim 1, wherein the cutouts of the side plates are formed such that the cutouts do not overlap intersecting lines of a plane and said side plates, wherein said plane passes through the charging wire and is parallel to the bottom plate.

3. A scorotron charger comprising:

an elongated housing formed of an electrically insulating material having opposing housing side walls and opposing end walls, said housing side walls and said end walls defining at least one elongated aperture;

a charging wire disposed between said end walls and said housing side walls, said charging wire being parallel to said housing side walls and a plane of said elongated aperture and above said plane of said elongated aperture;

an electrode member having a base plate with a base electrode grid and electrode side walls opposing one another and extending from said base plate, said electrode member being disposed in said elongated housing with said base electrode grid disposed below said charging wire to direct corona discharge through said elongated aperture;

said electrode side walls having apertures disposed therein and said housing side walls having projections for engaging respective ones of said apertures to secure said electrode member in said elongated housing; and said apertures being disposed in said electrode side walls such that a distance from a plane of said base electrode grid to nearest edges of said apertures is greater that a distance said charging wire is from said plane of said base electrode grid.

4. The scorotron charge according to claim 3 wherein:

a charging wire plane is defined which passes through a length of said charging wire and is parallel to a plane of said base electrode grid, said charging wire plane defining intersection lines where said charging wire plane intersects said electrode side walls; and said apertures are formed at positions in said electrode side walls such that said apertures do not overlap said intersection lines.

5. The scorotron charge according to claim 3 wherein said electrode side walls are parallel to one another and at right angles to said base plate.

* * * * *